United States Patent [19]

Scheibe

[11] 4,004,558

[45] Jan. 25, 1977

[54] HYDRAULIC LASH ADJUSTER OIL METERING VALVE

[75] Inventor: Elias W. Scheibe, Grand Rapids, Mich.

[73] Assignee: General Motors Corporation, Detroit, Mich.

[22] Filed: Sept. 2, 1975

[21] Appl. No.: 609,600

[52] U.S. Cl. ..... 123/90.35; 123/90.27; 123/90.43

[51] Int. Cl.[2] ..... F01M 9/10

[58] Field of Search ..... 123/90.35, 90.36, 90.46, 123/90.43, 90.27, 90.55

[56] References Cited

UNITED STATES PATENTS

| | | | |
|---|---|---|---|
| 2,857,895 | 10/1958 | Schiebe | 123/90.35 |
| 3,137,282 | 6/1964 | Voorhies | 123/90.35 |
| 3,153,404 | 10/1964 | Van Slooten | 123/90.43 |
| 3,273,548 | 9/1966 | Hoffman | 123/90.43 |
| 3,400,696 | 9/1968 | Thompson | 123/90.27 |
| 3,502,058 | 3/1970 | Thompson | 123/90.35 |
| 3,587,539 | 6/1971 | Dadd | 123/90.35 |

*Primary Examiner*—Charles J. Myhre
*Assistant Examiner*—Daniel J. O'Connor
*Attorney, Agent, or Firm*—Arthur N. Krein

[57] ABSTRACT

A hydraulic lash adjuster has a cylindrical body and a hollow plunger slidably received within the body, the upper portion of the plunger extending beyond the body and is provided with a semi-spherical end socketably received in the socket of a rocker arm. The plunger has an internal oil chamber in communication with the exterior of the body and its semi-spherical end is provided with a through passage whereby to effect lubrication of the rocker arm. A snap-fit oil metering valve is snapped into the passage in the semi-spherical end of the plunger to control flow through the aperture from the internal oil chamber of the plunger.

3 Claims, 5 Drawing Figures

HYDRAULIC LASH ADJUSTER OIL METERING VALVE

This invention relates to a hydraulic lash adjuster, such as used, for example, in internal combustion engines, for taking up clearance between the thrust transmitting parts in the valve train of the engine and, in particular, to a hydraulic lash adjuster having an improved oil metering valve therein.

When a hydraulic lash adjuster is used, for example, in an overhead cam engine to serve as the fulcrum for the rocker in the poppet valve operating train of the engine, it is desirable to provide for oil flow through the thrust member of the lash adjuster to effect lubrication of the rocker bearing surface and it is desirable to meter this flow with an oil control or metering valve.

Lash adjusters with such metering valves are well-known in the prior art. In one form of such lash adjusters, the plunger thereof is also of a tubular configuration whereby a separate thrust member can be suitably secured therein to permit the installation of a metering valve within the body internally of the plunger for controlling the flow of fluid from a chamber within the plunger through an aperture or passage in the thrust member to effect lubrication of a thrust receiving member in engagement with the thrust member, this thrust receiving member being either a push rod or a rocker arm.

In order to eliminate the necessity of making the plunger and thrust member as separate elements, a form of metering valve has been used in one type of commercially available lash adjuster which permits the use of a one-piece plunger having the thrust element formed integrally therewith at one end thereof, this form of metering valve being provided with a head and having an elongated solid shank extending therefrom. This form of metering element is assembled to the plunger by insertion of the shank from the exterior of the plunger into the passage extending through the thrust end of the plunger with the head of the metering valve seating against a suitable valve seat encircling the upper end of the passage in the plunger. Such a metering valve is sometimes referred to as a "jiggle valve".

However, since this last described form of metering valve was loosely received in the free end of the plunger, it could be readily separated from the plunger and could possibly be lost therefrom prior to insertion in an engine. Thus, for example, during servicing of an engine, if a mechanic was not familiar with this type lash adjuster having this form of metering valve therein, he could conceivably assume that this lash adjuster actually had a metering valve installed internally within the plunger and thus could actually install this particular lash adjuster in an engine without the metering valve therein.

It is therefore a primary object of this invention to provide a hydraulic lash adjuster with an improved metering valve therefor which is snap fitted into the plunger of the lash adjuster for retention therewith.

Another object of this invention is to provide an improved metering valve for a lash adjuster that is adapted to be snap fitted into an oil metering passage in the plunger of a hydraulic lash adjuster, the snap fit engagement of the metering valve effecting retention of the metering valve to the plunger.

A still further object of this invention is to provide a metering valve for a hydraulic lash adjuster which is of simple construction and which is economical to manufacture.

For a better understanding of the invention, as well as other objects and further features thereof, reference is had to the following detailed description of the invention to be read in connection with the accompanying drawings, wherein.

Figure 1:
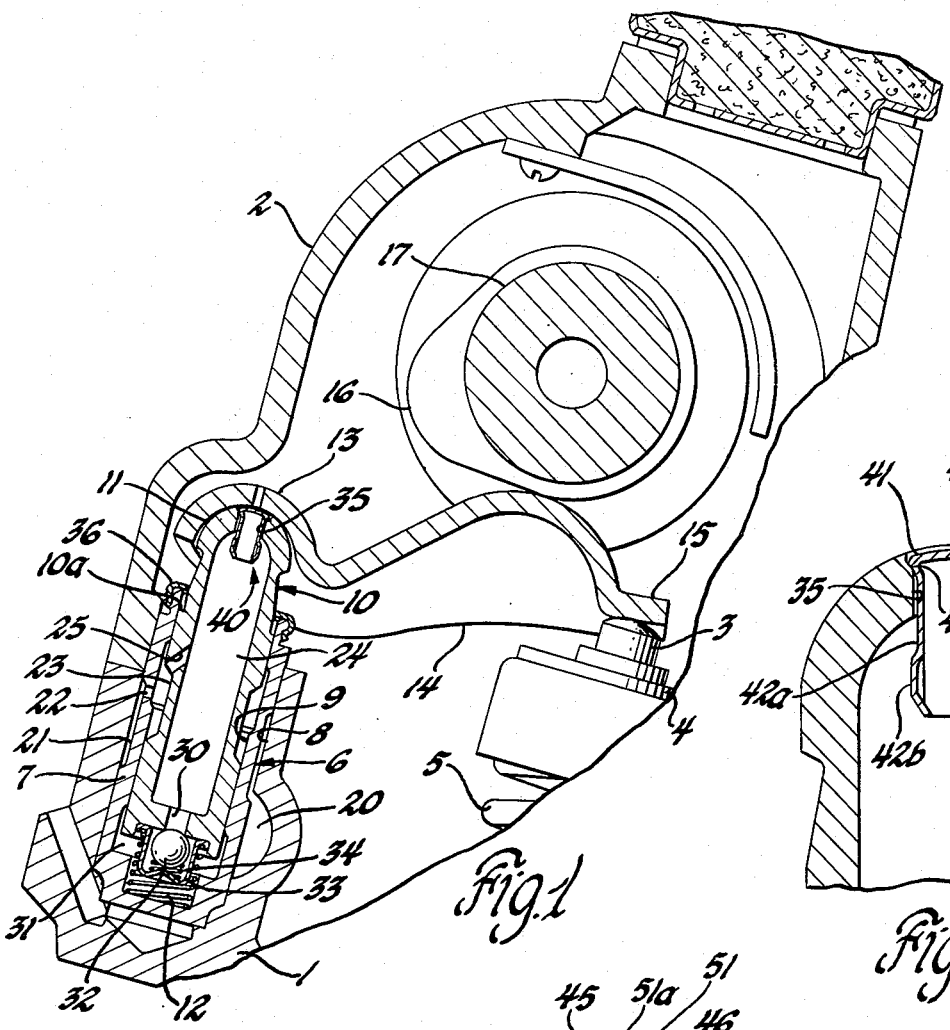
FIG. 1 is a transverse cross sectional view of a portion of an internal combustion engine showing a lash adjuster, with oil metering valve in accordance with a preferred embodiment of the invention, in its installed operating position therein.

Referring now in detail to the drawings, and first to FIG. 1, there is shown portions of an internal combustion engine including a cylinder head 1, to which is suitably affixed a cover 2. Slidably mounted in the head 1 is a poppet valve whose stem upper end is shown at 3. A conventional retainer washer 4 carried by the stem 3 is acted upon by the usual valve return spring 5, tending to elevate the stem to its uppermost position shown. To one side of the valve spring 5 is located a valve lash adjuster designated generally by the numeral 6. This includes a generally upright cup or cylindrical body 7 suitably seated in a pocket 8 formed in the cylinder head, this body 7 forming a dash pot for a plunger 10 slidably fitting in the bore 9 of the body 7 with its semi-spherically shaped upper thrust end 11 extending outward from the body to be engaged by the spherically concave end 13 of a rocker arm 14. A plunger return spring 12 is interposed between the bottom of the body 7 and the lower end of the plunger 10 and acts at all times to elevate the plunger to maintain its engagement with the spherically concave end 13 of the rocker arm 14. The opposite end 15 of the rocker arm rests on the valve stem end 3, and overlying the rocker and bearing thereagainst intermediate its ends is the usual cam lobe 16 of the engine camshaft 17. It will be appreciated that the camshaft 17 is suitably journaled for rotation and is suitably driven by the engine crankshaft (not shown).

Fluid for the dash pot of the lash adjuster is supplied in the form of oil from the engine lubricating pump (not shown) to a gallery 20 near the bottom of the pocket 8. Communicating at all times with this gallery is an external annular groove 21 on the body 7 which connects with a side port 22 leading into the bore 9 of the body. The plunger likewise has an external groove 23 which communicates with the body side port 22, and connecting this plunger groove with the interior or reservoir 24 of the plunger is a single inlet port 25.

The lower end of the plunger 10 is provided with the usual outlet port 30 by which oil within the oil reservoir 24 of the plunger may flow into the pressure chamber 31 provided between the lower end of the plunger 10 and the lower end of the body 7. Such flow is controlled by a check valve in the form of a ball 32 loosely retained opposite the lower end of the outlet port 30 by a valve cage 33 which, in turn, is held in place against the bottom of the plunger 10 by the previously described plunger return spring 12. The check valve or ball 32 is normally biased towards a seated position relative to the outlet port 30 by means of a valve spring 34 suitably positioned within the valve cage 33.

A stepped axial passage 35 is provided in the upper portion of the plunger 10, this passage extending through the upper, semi-spherical thrust end 11 of the plunger to enable oil within the reservoir 24 to lubricate the end 13 of the rocker arm 14. Flow through the passage is controlled by a snap fit, metering valve, generally designated 40, in accordance with a preferred embodiment of the invention shown in FIGS. 1, 2 and 3. These elements of the lash adjuster are held in unit assembly by a retainer ring 36 secured to the upper open end of body 7 to provide a radial inward shoulder for abutment against a shoulder 10*a* of plunger 10 to limit the axial movement of plunger 10 relative to dash pot body 7.

The metering valve 40, formed, for example, as a thin sheet metal stamping, includes an annular enlarged head 41 having a semi-spherical upper surface 41*a*, preferably formed complementary to the semi-spherical end 11 of the plunger 10, with a tubular thin walled shank 42 extending from the lower side of the head. The shank 42 includes a first portion 42*a* next adjacent to the head 41 of an axial extent greater than the axial extent of the passage 35 and with an outside diameter less than the inside diameter of the passage 35 to provide a predetermined diametral clearance therebetween for the flow of oil outward from the reservoir 24 to effect lubrication of the concave end of rocker arm 14. The shank 42 further includes a second or lower portion provided with radially outward extending spline projections 42*b* thereon, two such diametrically opposite radial spline projections being shown in the embodiment of the metering valve illustrated in FIGS. 1, 2 and 3 that are provided by deforming portions of the shank radially outward to provide these radial spline projections 42*b*, which extend longitudinally to join the lower or free end of the shank which terminates in a frusto-conical tip 43 having a minor diameter preferably less than the minor diameter of passage 35. The thin walls of the shank 42 permit limited flexing of the shank in the area of the spline projections 42*b* so that these spline projections, with a major outside diameter greater than the inside diameter of the passage 35, can be flexed radially inward to permit insertion of the metering valve into the passage 35 of plunger 10.

Thus, in assembly of the metering valve to the plunger 10, the free end of the shank, that is, its inclined ramp edge provided by the frusto-conical tip 43, is first inserted into the passage 35 and then, when axial pressure is applied against the head 41, this ramp edge formed by tip 43, which continues to the lower edges of the spline projections 42*b*, will cause this portion of the shank with the projections 42*b* thereon to flex radially inward allowing it to pass through the passage 35 and, once inserted therethrough, the radial spline projections 42*b* will then limit withdrawal of the metering valve from the plunger.

Figure 2:
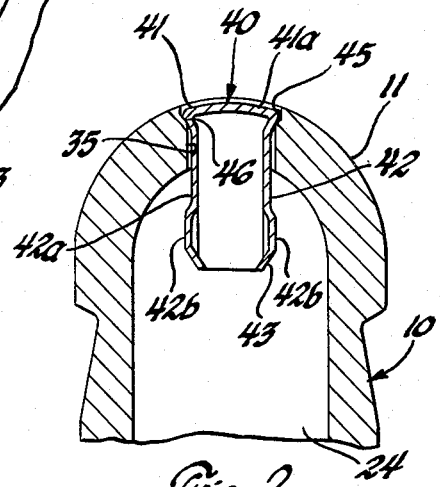
FIG. 2 is an enlarged view of a portion of the hydraulic lash adjuster of FIG. 1 with the oil metering valve therein.
Figure 3:
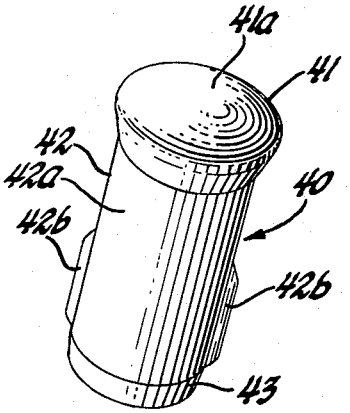
FIG. 3 is a further enlarged perspective view of the oil metering valve of FIGS. 1 and 2 as removed from a hydraulic lash adjuster.

As best seen in FIG. 2, the passage 35 is formed by a stepped bore extending from the outer surface of the semi-spherical end 11 of the plunger 10 through the wall of the plunger, this stepped bore providing a first annular internal wall 45 next adjacent to the outer surface of the semi-spherical end 11 which wall 45 is joined by a radially inward inclined shoulder 46, providing a valve seat for the metering valve, to the passage 35. The outside diameter of the head 41 of the metering valve 40 is slightly less than the inside diameter of the cylindrical wall 45 whereby the head 41 can be slidably received therein so that the lower surface of this head can seat against the radial shoulder 46. The height of the head 41 is less than the axial length of the cylindrical wall 45 to permit limited axial movement of the head before it engages the concave end 13 of rocker arm 14 to permit unseating of the head 41 relative to radial shoulder 46.

The metering valve 40, as thus assembled to the plunger 10, and although fixed to the plunger 10 is free for limited axial movement relative to passage 35 therein to permit unseating of the head 41 of the metering valve relative to the radial shoulder 46 thereby controlling the flow of oil from the plunger reservoir 24 out through the passage 35. Thus, during engine operation, oil is constantly fed under pressure via the gallery 20, the connecting groove 21 and side port 22 of body 7 and the connecting groove 23 and port 25 of plunger 10 to the reservoir 24, from which sufficient oil is admitted past the check valve 32 to maintain the pressure chamber 31 full of oil for a well-known purpose. The pressure of this oil in the reservoir will also effect unseating of the head 41 of metering valve 40, to permit oil flow through the passage 35 for lubrication of the socket connection between the plunger 10 and rocker arm 14. During engine shutdown, as the pressure of the oil in reservoir 24 is reduced, the head 41 of the metering valve 40 will seat against the shoulder 46 to help maintain a supply of oil in the reservoir 24.

Figure 4:
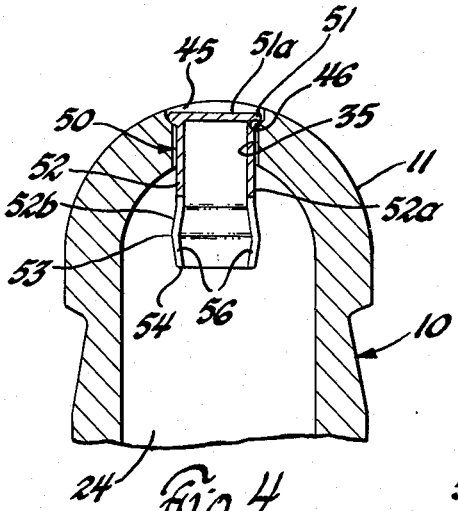
FIG. 4 is a view similar to that of FIG. 2 but showing the plunger of a lash adjuster with an alternate embodiment of the metering valve in accordance with the invention.
Figure 5:
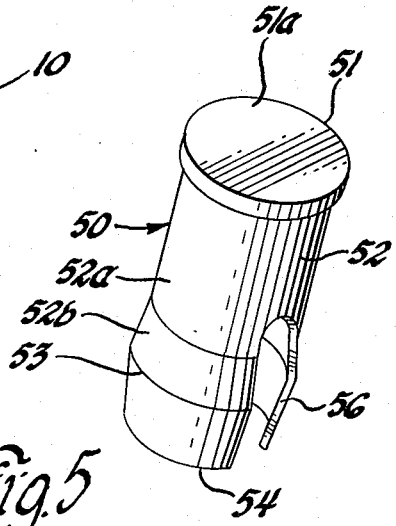
FIG. 5 is a further enlarged perspective view of the metering valve shown in FIG. 4 but removed from the lash adjuster.

Referring now to the alternate embodiment of the metering valve, generally designated 50, shown in FIGS. 4 and 5, it includes an enlarged annular head 51 having a flat upper surface 51*a* from which depend a thin-walled, hollow stud or shank indicated generally at 52. The outside diameter of head 51 is less than the inside diameter of annular wall 45 to permit the head to be slidably received therein and the axial extent of the head 51 is such so that its upper surface will not protrude axially outward from the semi-spherical end 11 of the plunger 10 when this valve is in its seated position thereby permitting limited axial movement of the head to effect unseating of this metering valve element. Externally, the stud or shank 52 is provided next adjacent the head with a straight tubular first shank portion, designated 52*a*, of a diameter less than the inside diameter of passage 35 and of an axial extent greater than the axial extent of passage 35 to permit oil flow therebetween which joins a second shank portion, designated 52*b*, which increases in diameter up to a point 53 and then decreases in diameter to an open free end or tip 54 of frusto-conical configuration, with a minimum diameter at the end of tip 54 corresponding to but slightly less than the inside diameter of passage 35 and a major outside diameter at point 53 greater than the inside diameter of passage 35. The second shank portion 52*b* is divided longitudinally by spaced apart slots 56, two such diametrically opposed slots 56 in the embodiment shown, thus forming a pair of shank segments which are resilient and allow this portion of the shank to be compressed radially inward with respect to the longitudinal axis of the metering valve to permit its insertion through the passage 35. The metering valve 50 is operable in the same manner as the metering valve 40, as previously described.

What is claimed is:

1. In a hydraulic lash adjuster, a cylindrical outer dash pot body, a hollow plunger telescopically received in said outer dash pot body with one end of said plunger extending outward from said outer dash pot body, said one end terminating in a semi-spherical end having an axial extending passage means therethrough to the interior of said plunger, the interior of said plunger constituting a reservoir for supplying fluid to said outer dash pot body inwardly of said plunger and for delivery out through said passage and, a metering valve for controlling flow from the interior of said plunger outward through said passage, the improvement wherein said passage means includes a first bore portion extending from the outer surface of said semi-spherical end, a second bore portion of a smaller diameter than said first bore portion, said first bore portion and said second bore portion meeting coaxially with an intervening inclined shoulder providing a valve seat and, wherein said metering valve includes an annular head with a depending, hollow shank extending from one side thereof, said shank having a first shank portion next adjacent said head of a predetermined axial length greater than the axial length of said passage and having an outside diameter less than the inside diameter of said second bore portion to provide an oil metering passage between said first shank portion and the inside diameter of said second bore portion, said shank further having a second shank portion next adjacent the free end thereof, said second shank portion having a major outside diameter greater than the inside diameter of said second bore portion, said head being of a diameter larger than the outside diameter of said first portion of said shank, both the diameter of said head and said major outside diameter of said second shank portion being less than the diameter of said first bore portion.

2. In a hydraulic lash adjuster according to claim 1 wherein said second shank portion of said metering valve includes a tubular section having radial spline projections thereon with the minor diameter of said tubular section corresponding to the diameter of said first shank portion, said tubular section with said radial spline projections thereon terminating in a frusto-conical section having a minor diameter less than the diameter of said second bore portion.

3. In a hydraulic lash adjuster according to claim 1 wherein said second shank portion of said metering valve has an outer surface joining said first shank portion which increases in diameter to said major diameter intermediate the ends of said second shank portion, said outer surface joining at said major diameter a frusto-conical section of decreasing diameter and, wherein said second shank portion has longitudinally extending slot means therein to permit flexing of said second shank portion radially inward.

* * * * *